United States Patent [19]

Klungle et al.

[11] Patent Number: 4,971,404

[45] Date of Patent: Nov. 20, 1990

[54] LATERAL FILE CABINET

[75] Inventors: Mark C. Klungle, Fennville; Udell L. Blanchard, Jr., Grandville, both of Mich.

[73] Assignee: American Seating Company, Grand Rapids, Mich.

[21] Appl. No.: 366,624

[22] Filed: Jun. 15, 1989

[51] Int. Cl.[5] ..... A47B 88/00

[52] U.S. Cl. ..... 312/323

[58] Field of Search ..... 312/322, 323, 220, 109

[56] References Cited

U.S. PATENT DOCUMENTS

| | | | |
|---|---|---|---|
| 631,312 | 8/1899 | Macey | 312/323 X |
| 2,669,499 | 2/1954 | Varderplank | 312/322 |
| 2,723,177 | 11/1955 | Belew | 312/322 |
| 4,389,078 | 6/1983 | Streit | 312/322 |
| 4,600,254 | 7/1986 | Whalen | 312/323 |

*Primary Examiner*—Joseph Falk

*Attorney, Agent, or Firm*—Waters, Morse & Harrington

[57] ABSTRACT

A file-drawer cabinet with a retracting panel normally covering the top drawer opening has cut-out areas on the front flanges of the cabinet corner members. These flanges are partially overlapped by the side edges of the lower drawers. The top drawer cover panel retracts through the cut-out areas, making the top panel width equal to the width of the lower drawers.

5 Claims, 3 Drawing Sheets

LATERAL FILE CABINET

BACKGROUND OF THE INVENTION

File-drawer cabinets commonly have the top drawer modified to provide frontal access, so the office personnel will not have to use stools or step ladders. Working over the front of the drawer is difficult for the average person when more than four drawers of standard height are present in the cabinet. The usual modification of the top drawer is the elimination of the front panel of the drawer, and the addition of a retractable cover over the top drawer opening.

This feature produces design problems. The cabinet structure usually uses vertical members of angular cross section at the front corners, providing front flanges extending from a half to three-quarters of an inch inward from the plane of the side of the cabinet. For appearances, it is desirable to cover the slight opening between the flanges and the edges of the drawer, and the usual practice has been to provide front drawer panels that overlap the flanges when the drawers are closed. The retracting cover panel for the top drawer opening, however, has to move inside the flanges, and therefore the cover panels have not been capable of overlapping the front edge flanges of the cabinet. To do so would block the retraction. The result of this situation is that the covering position of the top closure panel presents an irregularity due to the vertical misalignment of the edges of the top panel with the edges of the lower drawers.

Accumulations of tolerance in manufacturing make it undesirable to align the edges of the fronts of the drawers with the outer extremities of the cabinet. To attempt this inevitably produces irregularities that are unsightly, and also could present possible clearance problems in the drawer movement with respect to adjacent objects. This invention provides a solution to these two problems without seriously weakening the cabinet.

SUMMARY OF THE INVENTION

A cabinet embodying this invention has cut-out areas extending into the front edge flanges of the cabinet for a fraction of the width of these flanges. The top closure panels retract in a horizontal position into these cut-out areas, permitting a panel width that overlaps the flanges below the cut-out areas. The lower drawer front panels are adapted to provide the same degree of overlap, leaving the edges of all of the front panels in vertical alignment. These edges are also set back somewhat from the plane of the side of the cabinet. Provision of a corner radius on the cabinet permits considerable accumulation of tolerance without interfering with the appearance, as the presence of the radius tends to remove a visual reference that will call attention to misalignment. This arrangement also produces dimensional similarity of the front panels for manufacturing simplicity. The maintenance of some of the flange width also preserves the strength and rigidity of the cabinet at this point.

DESCRIPTION OF THE PREFERRED EMBODIMENT

Figure 1:
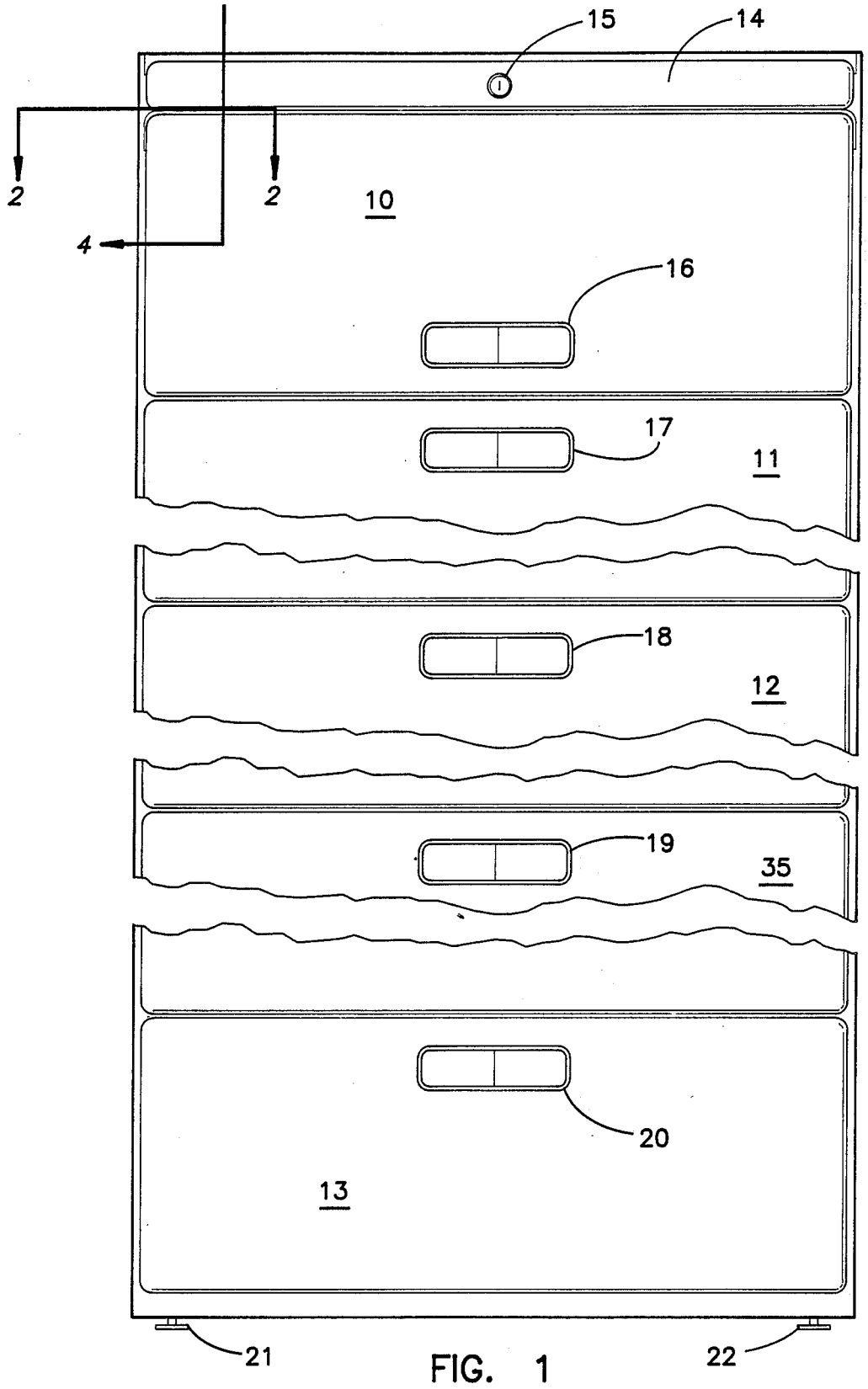
FIG. 1 is a front elevation of a lateral life cabinet of the usual exterior proportions.
Figure 2:
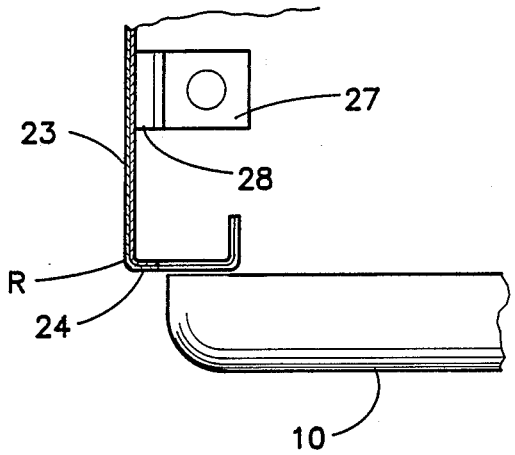
FIG. 2 is a section on an enlarged scale on the plane 2—2 of FIG. 1.

Referring to FIG. 1, the illustrated cabinet carries the top drawer cover 10 and the lower drawers 11, 12, 13 and 35. The vertically short auxiliary closure panel 14 is normally part of the fixed cabinet structure, and often contains a key lock in the position indicated at 15. The drawer labels 16–20 are conventional. Adjustable leveling devices as shown at 21 and 22 in FIG. 1 are normally provided at the four corners of the bottom of the cabinet.

The front panels associated with the drawers 11–13 and 35 are part of the drawers, and move with the drawers. The cover panel 10, however, is separately retractable into the cabinet after it has been elevated to a horizontal position. It then is adapted to move rearwardly into the cabinet to expose the drawer opening. The top drawer may then be pulled out, or the storage space may be utilized through the frontal access provided by the retraction of the cover panel.

Figure 3:
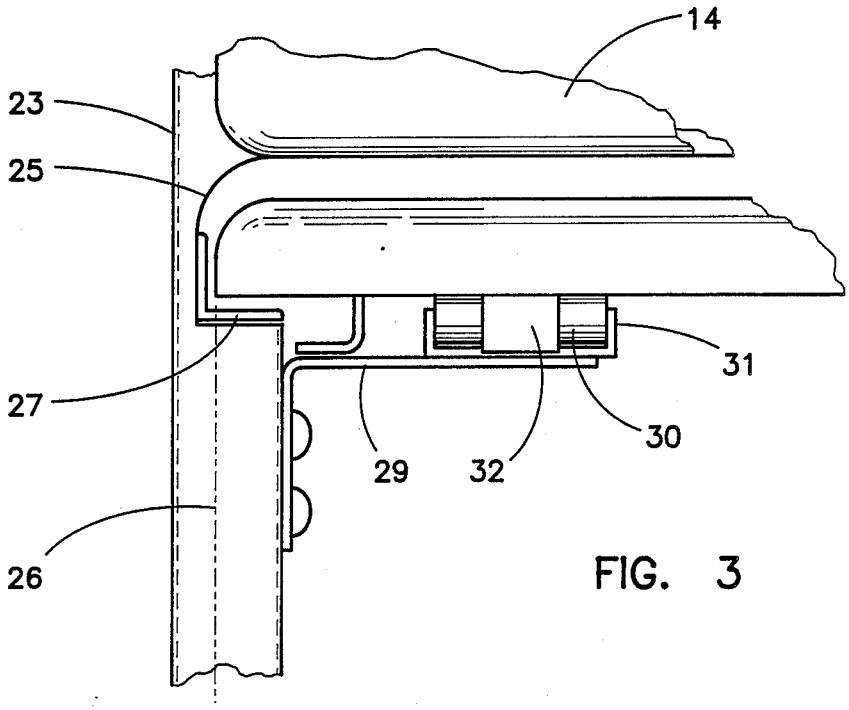
FIG. 3 is a fragmentary view on an enlarged scale at the upper left corner of the cabinet shown in FIG. 1.

Referring to FIG. 3, the front vertical edges of the cabinet will normally have an angular cross-section on a horizontal plane, which may either be formed as a section bent with a corner radius R from the sheet metal forming the side of the cabinet indicated at 23 in FIG. 3, or maybe a separate angle member joined to the side panel by welding or other procedures. In either case, the result is a front edge flange 24 that extends inward from the plane of the side 23 normally a half to three-quarters of an inch. This structure is duplicated at the opposite side of the cabinet, with both of the flanges 24 facing inward toward the center of the cabinet structure. These flanges are cut away as shown at 25 for a fraction of the full width of the flanges to provide for the retraction of the top closure panel 10 into the cabinet through these cut-out areas. The front panels of the lower drawers must be the same width as the top closure panel 10, with all of them overlapping the flanges 24 to the same degree. These panels all close into a line of vertical alignment indicated at 26 in FIG. 3.

Figure 4:
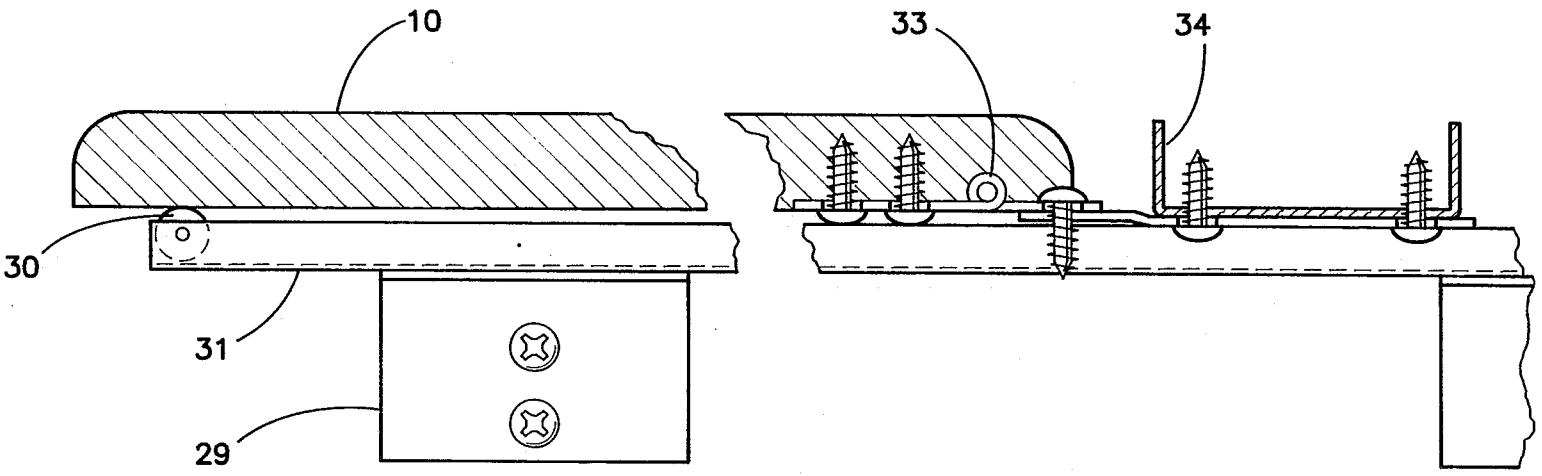
FIG. 4 is a view on the Plane 4—4 of FIG. 1
Figure 5:
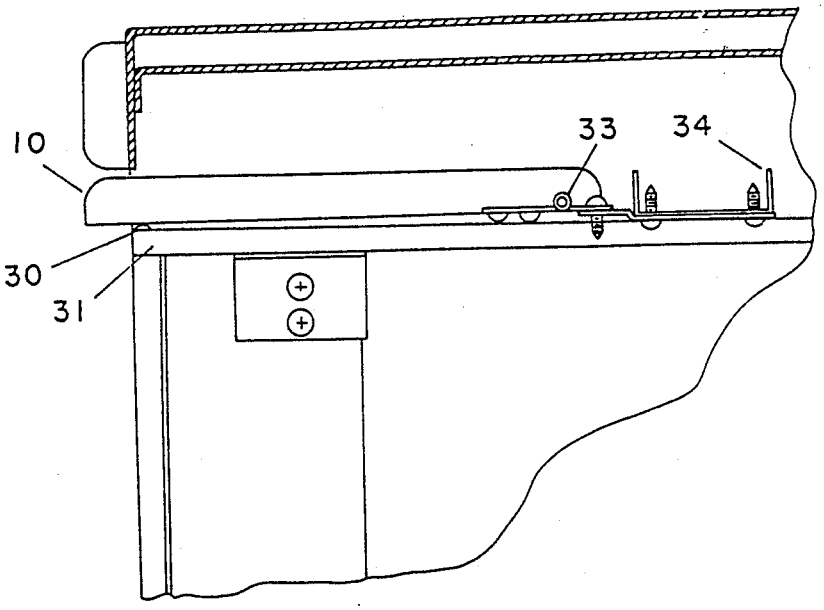
FIG. 5 is a view on the plane 4—4 of FIG. 1, showing the panel in the retracted position.
Figure 6:
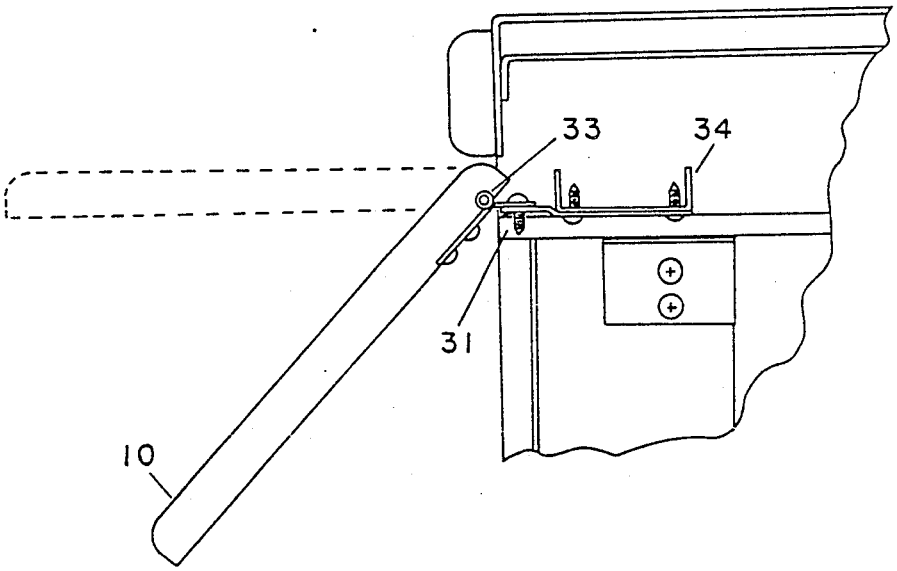
FIG. 6 is a view on the plane 4—4 of FIG. 1, showing the panel extended and partially lowered toward a vertical position.

The plastic angle piece 27 is carried by the bracket 28 secured to the side 23 of the cabinet structure to provide a low-friction guiding surface for the side edge of the top closure panel 10 during its sliding movement. The remainder of the interior structure in this area is conventional, including the roller bracket 29 secured to the cabinet, and carrying rollers as shown at 30 mounted in the channel beam 31. This structure is best shown in FIG. 4. Stops limiting the movement of the panel to its retracted position are usually employed as shown at 32 in FIG. 3. The front closure panel 10 is hinged as shown at 33 to a beam 34 that remains within the cabinet at all times, so that the front closure panel 10 may be swung down about the hinge 33 to assume the fully closed covering position appearing in FIG. 1.

I claim:

1. A file drawer cabinet having a top drawer and at least one lower drawer, and having opposite front vertical edge members providing front flanges, said lower drawer having a front panel overlapping said edge member flanges, and said cabinet also having a retractable cover panel adapted in a vertical position of said cover panel to cover said top drawer in the retracted position of said top drawer, and retract into said cabinet in a horizontal position, said cabinet having guideway means receiving said cover panel for movement between extended and retracted positions wherein the improvement comprises: means forming a lateral cut-out in each of said flanges adjacent said top drawer, said cover panel being receivable in the space between said cut-outs, said cover panel being adapted to overlap said edge member flanges in a vertical position of said cover panel, and retract into said cabinet at said cut-outs.

2. A cabinet as defined in claim 1, wherein said cut-outs are disposed above said top drawer.

3. A cabinets as defined in claim 1, wherein said cut-outs are limited to a fraction of the width of said front flanges.

4. A cabinet as defined in claim 1, wherein the side edges of said lower drawer front panel are in vertical alignment with the side edges of said cover panel in the closed positions of said panel.

5. A cabinet as defined in claim 1, additionally including at least one guiding member of low-friction material secured to the interior of said cabinet, and disposed to position said cover panel to prevent engagement thereof with said flanges.

* * * * *